United States Patent [19]

Tachiyama

[11] 3,972,426

[45] Aug. 3, 1976

[54] DEVICE FOR CHARGING MATERIALS INTO BLAST FURNACE

[75] Inventor: Kanjyo Tachiyama, Kure, Japan

[73] Assignee: Ishikawajima-Harima Jukogyo Kabushiki Kaisha, Tokyo, Japan

[22] Filed: Feb. 1, 1974

[21] Appl. No.: 438,558

[30] Foreign Application Priority Data

Feb. 2, 1973 Japan ..... 48-13546

[52] U.S. Cl. ..... 214/35 R; 266/184

[51] Int. Cl. ..... C21b 7/00

[58] Field of Search ..... 214/18 V, 18.2, 17 CB, 214/35 R, 35 A, 36, 37; 266/27

[56] References Cited

UNITED STATES PATENTS

| | | | |
|---|---|---|---|
| 1,668,968 | 5/1928 | Lambot | 214/35 R |
| 3,651,964 | 3/1972 | Nieboer | 214/36 |

FOREIGN PATENTS OR APPLICATIONS

| | | | |
|---|---|---|---|
| 537,669 | 5/1922 | France | 214/35 |
| 861,978 | 1/1953 | Germany | 266/27 |

*Primary Examiner*—Gerald A. Dost

*Attorney, Agent, or Firm*—Scrivener Parker Scrivener & Clarke

[57] ABSTRACT

A device for charging materials into a blast furnace is disclosed in which a gear box which supports rotatably a ring gear has a pair of shafts swingably supported by a casing joined to the top of the furnace in such a way that the gear box may be caused to swing about the pair of shafts when the latter are driven. Furthermore, a chute is disposed within the gear box in such a way that it may be caused to swing in the directions at right angles to those of the swinging of the gear box by the rotation of the ring gear which in turn is driven by a drive shaft.

5 Claims, 5 Drawing Figures

Fig. 2
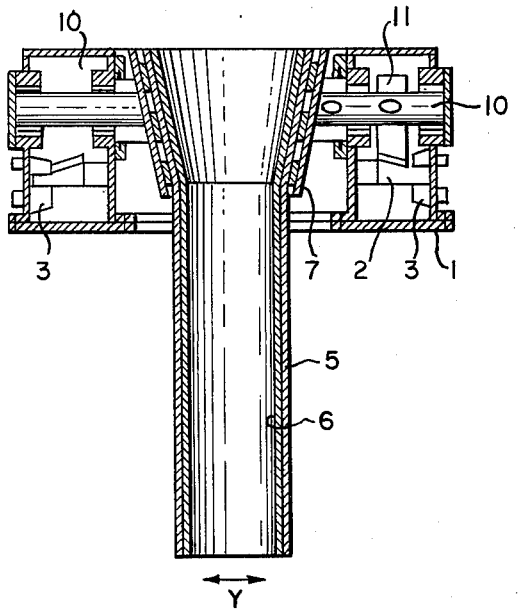
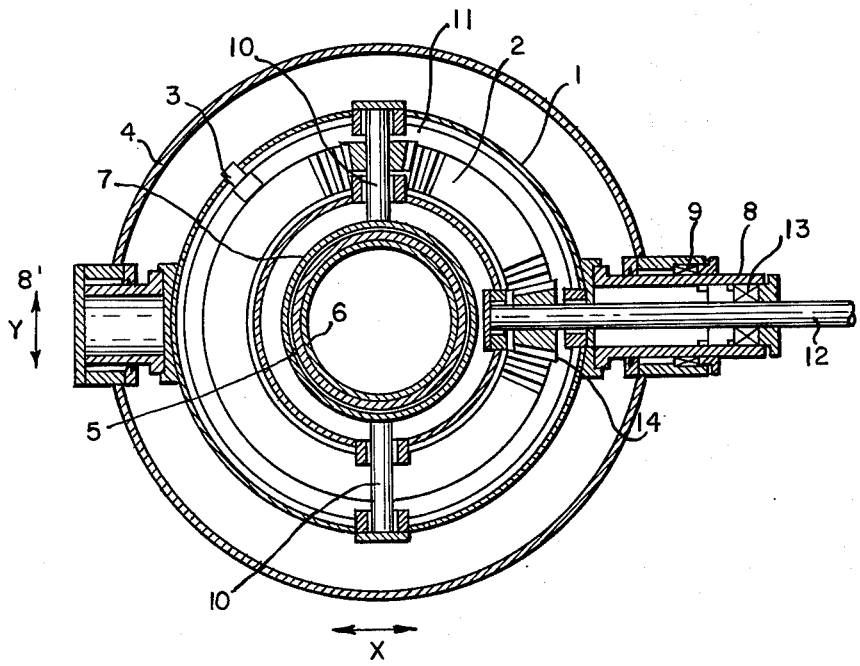
Fig. 3

DEVICE FOR CHARGING MATERIALS INTO BLAST FURNACE

The present blast furnaces have a large capacity and use a high top pressure so that bells which charge the materials into the furnaces as well as their associated parts are also large in size. Furthermore, a large movable armor is used in order to distribute the materials charged into the furnace.

One of the objects of the present invention is therefore to provide a device for uniformly distributing materials in a blast furnace without using a large-sized bell and movable armor.

Another object of the present invention is to provide a device for charging materials into a blast furnace whose component parts may be made compact in size.

The above and other objects, features and advantages of the present invention will become more apparent from the following description of one preferred embodiment thereof taken in conjunction with the accompanying drawing in which:

FIG. 2 is a sectional view taken along the line A of FIG. 1;

FIG. 3 is a sectional view taken along the line B of FIG. 1;

Figure 1:
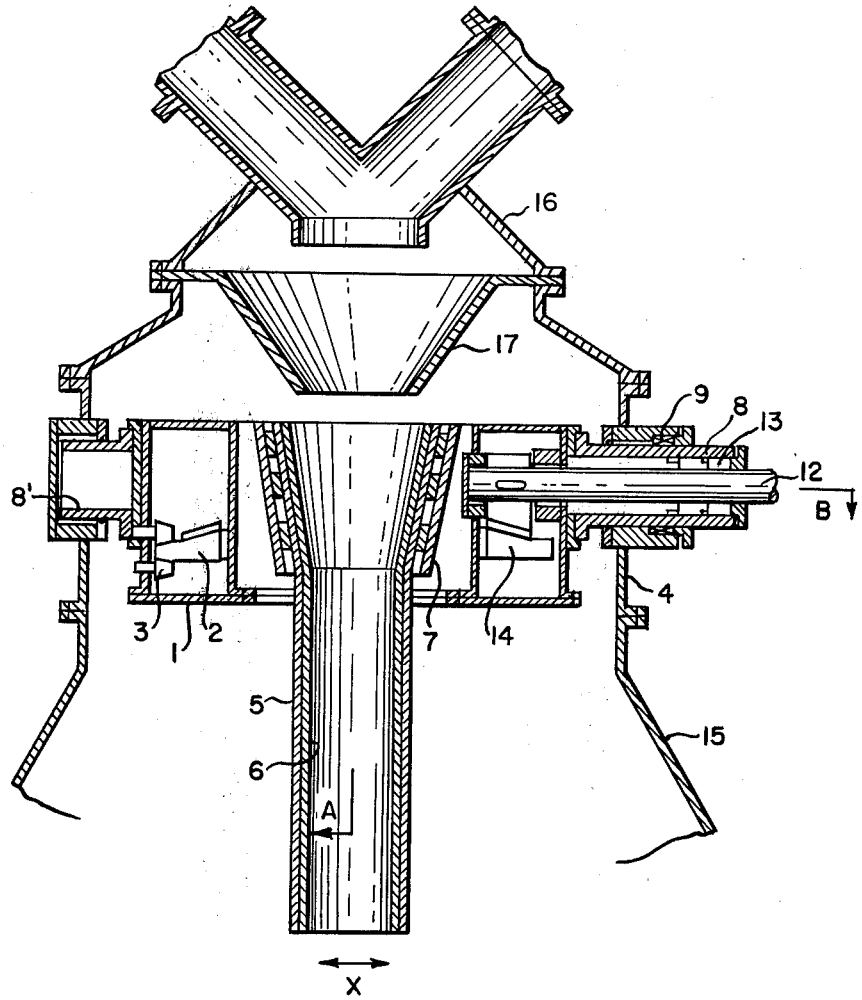
FIG. 1 is a sectional view of a device for charging into and distributing materials in a blast furnace in accordance with the present invention.

Referring to FIGS. 1, 2, and 3, a gear box 1 disposed within a cylindrical casing 4 coaxially thereof has a plurality of supporting rollers 3 which support rotatably a ring gear 2 having teeth formed on the top surface thereof. An inverted frustoconical support 7 disposed within the gear box 1 coaxially thereof holds a chute 5 whose inner wall is lined with anti-abrasive-wear material 6. The gear box 1 is rotatably carried by a pair of shafts 8 and 8' which in turn are securely fixed horizontally to the outer wall of the gear box 1 diametrically thereof, and packings 9 are so fitted over the shaft 8 as to provide the gas-tightness.

The support 7 is rotatably supported by a pair of shafts 10 which in turn are horizontally supported by the outer wall of the gear box 1 at right angles to the shafts 8 and 8', and a pinion 11 carried by one of the pair of shafts 10 is in mesh with the ring gear 2 within the gear box 1.

The shaft 8 is extended out of the casing 4 and a drive shaft 12 is rotatably supported within the shaft 8. A packing 13 is fitted between the drive shaft 12 and the shaft 8 so as to provide gas-tightness, and a pinion 14 carried at the inner end of the drive shaft 12 is in mesh with the ring gear 2 as best shown in FIG. 3.

When the drive shaft 8 is driven by a prime mover (not shown), the gear box 1 and hence the holder 7 and the chute 5 are swung about the shafts 8 and 8'. When the drive shaft 12 is driven by a prime mover (not shown), the holder 7 and hence the chute 5 are swung about the shafts 10 in the directions at right angles to those of the swinging of the gear box 1.

The gas-tightness of the gear box 1 is ensured because the shafts 10 and 12 are gas-tightly supported. The casing 4 is joined to the top 15 of a blast furnace so that the materials may be charged directly into the furnace through the chute 5 as best shown in FIG. 1. The casing 4 is joined to a fixed chute 17 which in turn is joined to cover 16.

Figure 4:
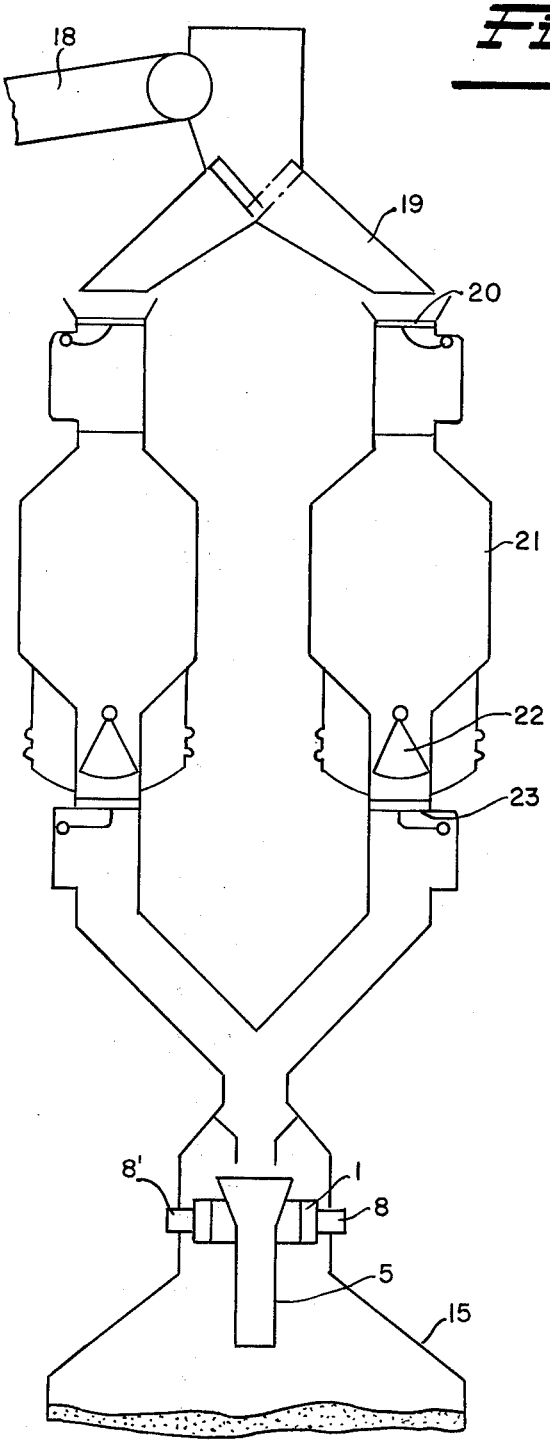
FIG. 4 is a schematic view of the device shown in FIG. 1 mounted on a bell-less furnace top.

FIG. 4 shows the material charging and distributing device in accord with the present invention mounted on the bell-less furnace top. Materials transported by a conveyor 18 is charged into fixed hoppers 21 through distribution chutes 19 and sealing valves 20, and then directly charged into the furnace through gates 22, sealing valves 23 and the material charging device of the present invention.

Figure 5:
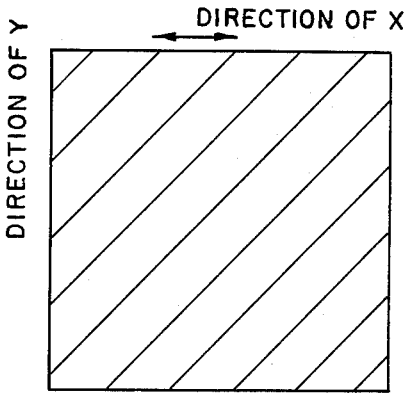
FIG. 5 is a view used for the explanation of the range in which a chute of the device shown in FIG. 1 is movable in the furnace.

Next the mode of operation will be described in more detail hereinafter. When the drive shaft 12 is rotated in one direction, the pinion 14 carried by the drive shaft 12 is rotated to rotate the ring gear 2 so that the pinion 11 is rotated to rotate the shaft 10. Therefore the holder 7 and hence the chute 5 is caused to swing in the directions indicated by the double-pointed arrow X. Thus the materials may be charged into the furnace in the radial direction. When the shafts 8 are rotated, the gear box 1 is caused to swing about the shafts 8 and 8' so that the holder 7 and hence the chute 5 which are supported by the gear box 1 by the shafts 10 are also caused to swing in the directions indicated by the double-pointed arrow Y. Thus the materials are also charged in the radial direction of the furnace. When the shafts 8 and the drive shaft 12 are rotated, the chute 5 is caused to swing in the directions perpendicular to each other. Therefore, when the rotational speeds of the drive shaft 12 and the shafts 8 are suitably controlled, the chute 5 may be swung to draw a circle, arcs or straight lines as shown in FIG. 5 so that the materials may be distributed over a wide range within the furnace.

In operation, the gear box 1 is exposed to the furnace gases containing a large amount of dust, but as described hereinbefore it is completely sealed so that the intrusion of dusts into the gear box 1 may be prevented. Furthermore, the gear box 1 is cooled by oil or water so as to withstand the high temperature.

When the replacement or repair of the chute 5 is required to cover 16 and the fixed chute 17 are removed and only the chute 5 is lifted. Since the chute 5 is held by the inverted frustoconical chute holder 7, it may be lifted in a simple manner.

It is to be understood that the present invention is not limited to the above embodiment and that various modifications may be made. The charging device of the present invention may be also used with the furnace top having, for instance, three hoppers or with the furnace top having a bell.

The advantages of the present invention may be summarized as follows:

I. The chute may be swung in any direction by a simple mechanism.

II. Therefore, the materials may be uniformly or not uniformly distributed in the furnace. Furthermore the prior art movable armor may be eliminated.

III. The conventional large parts such as bells, suspension rods, gas seal metals, bell levers and so on may be eliminated. The parts of the material charging device in accord with the present invention may be made compact in size and standardized.

IV. The parts are made compact in size and formed as a block so that the handling and replacement may be much simplified.

What is claimed is:

1. A device for charging materials into a blast furnace comprising a casing, a gear box positioned within the casing, a chute positioned within the gear box, a first pair of shafts fixed to said gear box for supporting the latter in the casing for rotatable movement about the axis of said shafts, a second pair of shafts carried by the gear box and positioned perpendicularly to the axis of the first pair of shafts, said chute supported by the second pair of shafts, a ring gear rotatably mounted in the gear box, a pinion carried by one of the shafts of said second pair and meshing with the ring gear, means for mounting one of said shafts of said first pair and said gear box for rotation to swing the chute in one direction, a drive shaft rotatably carried by the gear box, said drive shaft carrying a pinion meshing with the ring gear, and means for mounting the drive shaft for rotation to rotate the last-named pinion, the ring gear and the first-named pinion to swing the chute in a direction perpendicular to said one direction.

2. A device as defined in claim 1 wherein said ring gear is supported within said gear box by a plurality of supporting rollers.

3. A device as defined in claim 1 wherein one of said first pair of shafts is a hollow shaft through which is extended said drive shaft for driving said ring gear.

4. A device as defined in claim 1 wherein said chute is held by an inverted frustoconical holder which is disposed within said gear box coaxially thereof.

5. A device as defined in claim 1 wherein said first pair of shafts and said drive shaft are fitted with packings.

* * * * *